US008979682B2

(12) United States Patent
Chuang et al.

(10) Patent No.: US 8,979,682 B2
(45) Date of Patent: Mar. 17, 2015

(54) BALL BAT INCLUDING A REINFORCED, LOW-DURABILITY REGION FOR DETERRING BARREL ALTERATION

(75) Inventors: Hsing-Yen Chuang, Simi Valley, CA (US); Dewey Chauvin, Simi Valley, CA (US)

(73) Assignee: Easton Baseball/Softball Inc., Van Nuys, CA (US)

( * ) Notice: Subject to any disclaimer, the term of this patent is extended or adjusted under 35 U.S.C. 154(b) by 49 days.

(21) Appl. No.: 13/333,498

(22) Filed: Dec. 21, 2011

(65) Prior Publication Data

US 2013/0165279 A1 Jun. 27, 2013

(51) Int. Cl.
*A63B 59/06* (2006.01)

(52) U.S. Cl.
CPC ..... *A63B 59/06* (2013.01); *A63B 2209/02* (2013.01); *A63B 2209/10* (2013.01)
USPC ..... 473/566; 473/567

(58) Field of Classification Search
USPC ..... 473/457, 519, 520, 564–568
See application file for complete search history.

(56) References Cited

U.S. PATENT DOCUMENTS

| | | | | |
|---|---|---|---|---|
| 3,861,682 | A | 1/1975 | Fujii | |
| 3,963,239 | A | 6/1976 | Fujii | |
| 4,600,193 | A | 7/1986 | Merritt | |
| 4,604,319 | A | 8/1986 | Evans et al. | |
| 4,818,584 | A | 4/1989 | Eisenmann | |
| 4,963,408 | A | 10/1990 | Huegli | |
| 5,057,353 | A | 10/1991 | Maranci et al. | |
| 5,094,453 | A * | 3/1992 | Douglas et al. | 473/566 |
| 5,364,095 | A * | 11/1994 | Easton et al. | 473/566 |
| RE35,081 | E | 11/1995 | Quigley | |
| 5,556,695 | A | 9/1996 | Mazelsky | |
| 5,641,366 | A | 6/1997 | Hohman | |
| 5,676,610 | A | 10/1997 | Bhatt et al. | |
| 5,961,405 | A * | 10/1999 | MacKay, Jr. | 473/566 |
| 6,033,758 | A | 3/2000 | Kocher et al. | |
| 6,053,827 | A | 4/2000 | MacKay, Jr. et al. | |
| 6,257,997 | B1 | 7/2001 | Doble et al. | |
| 6,265,333 | B1 | 7/2001 | Dzenis et al. | |
| 6,287,222 | B1 | 9/2001 | Pitsenberger | |
| 6,471,608 | B1 | 10/2002 | Mitchell | |
| 6,508,731 | B1 * | 1/2003 | Feeney et al. | 473/567 |
| 6,612,945 | B1 * | 9/2003 | Anderson | 473/566 |
| 6,723,012 | B1 | 4/2004 | Sutherland | |
| 6,729,983 | B1 | 5/2004 | Vakili et al. | |
| 6,755,757 | B2 | 6/2004 | Sutherland | |
| 6,761,653 | B1 | 7/2004 | Higginbotham et al. | |
| 6,949,038 | B2 | 9/2005 | Fritzke | |
| 7,006,947 | B2 | 2/2006 | Tryon, III et al. | |
| 7,011,588 | B2 * | 3/2006 | Fritzke et al. | 473/567 |
| 7,044,871 | B2 | 5/2006 | Sutherland et al. | |

(Continued)

OTHER PUBLICATIONS

United States Patent and Trademark Office, International Search Report and Written Opinion for PCT/US2012/070184, Feb. 12, 2013.

*Primary Examiner* — Mark Graham
(74) *Attorney, Agent, or Firm* — Perkins Coie LLP

(57) ABSTRACT

A ball bat includes one or more low-durability regions fortified by one or more reinforcing elements. If the reinforcing element is altered or removed, the durability of the ball bat is significantly reduced. For example, if the ball bat is subjected to internal shaving or external rolling in an attempt to increase the bat's performance, the reinforcing element would de removed or damaged such that the durability of the bat is reduced to the point that the ball bat's performance remains below a specified limit.

19 Claims, 2 Drawing Sheets

(56) References Cited

U.S. PATENT DOCUMENTS

| | | | | |
|---|---|---|---|---|
| 7,087,296 | B2 | 8/2006 | Porter | |
| 7,115,054 | B2 | 10/2006 | Giannetti et al. | |
| 7,175,552 | B2 | 2/2007 | Fritzke et al. | |
| 7,232,387 | B1 | 6/2007 | Heald et al. | |
| 7,320,653 | B2 | 1/2008 | Fitzgerald et al. | |
| 7,798,926 | B1 | 9/2010 | Hsu | |
| 7,850,554 | B2 | 12/2010 | Burger | |
| 7,857,719 | B2 | 12/2010 | Giannetti et al. | |
| 7,867,114 | B2 * | 1/2011 | Sutherland et al. | 473/567 |
| 7,874,946 | B2 | 1/2011 | Smith | |
| 7,914,404 | B2 | 3/2011 | Giannetti et al. | |
| 8,197,366 | B2 * | 6/2012 | Chauvin et al. | 473/566 |
| 8,298,102 | B2 * | 10/2012 | Chauvin et al. | 473/566 |
| 8,449,412 | B2 * | 5/2013 | Vander Pol et al. | 473/566 |
| 8,480,519 | B2 * | 7/2013 | Chauvin et al. | 473/566 |
| 8,506,429 | B2 * | 8/2013 | Chauvin et al. | 473/566 |
| 2003/0153416 | A1 * | 8/2003 | Anderson | 473/566 |
| 2004/0082413 | A1 | 4/2004 | Leal et al. | |
| 2005/0176531 | A1 | 8/2005 | Fitzgerald et al. | |
| 2005/0227795 | A1 | 10/2005 | Fritzke | |
| 2005/0237205 | A1 | 10/2005 | Gorst | |
| 2005/0247764 | A1 | 11/2005 | Sierra-Gomez et al. | |
| 2006/0019779 | A1 * | 1/2006 | Fritzke et al. | 473/567 |
| 2006/0025253 | A1 * | 2/2006 | Giannetti et al. | 473/567 |
| 2006/0229147 | A1 | 10/2006 | Nusbaum et al. | |
| 2006/0232057 | A1 | 10/2006 | Dome | |
| 2007/0042844 | A1 | 2/2007 | Stote et al. | |
| 2007/0219027 | A1 * | 9/2007 | Chong | 473/564 |
| 2008/0070726 | A1 * | 3/2008 | Watari et al. | 473/566 |
| 2008/0234075 | A1 * | 9/2008 | Lancisi | 473/457 |
| 2009/0280934 | A1 * | 11/2009 | Watari et al. | 473/566 |
| 2010/0160095 | A1 | 6/2010 | Chauvin et al. | |
| 2011/0111892 | A1 * | 5/2011 | Thouin et al. | 473/520 |
| 2011/0124447 | A1 * | 5/2011 | Chauvin et al. | 473/566 |
| 2011/0152015 | A1 | 6/2011 | Burger | |
| 2013/0035181 | A1 * | 2/2013 | Chauvin et al. | 473/566 |

* cited by examiner

BALL BAT INCLUDING A REINFORCED, LOW-DURABILITY REGION FOR DETERRING BARREL ALTERATION

BACKGROUND

A growing number of baseball and softball players alter bat barrels in an effort to increase the performance of ball bats. Ball players, for example, have been known to remove a bat's cap and to shave or machine away material from the inner surface of the bat barrel to reduce the weight of the bat, which results in increased bat speed—and better bat performance—when the player swings the bat and strikes a ball. Once the cap is replaced on the bat, the tampering with the interior of the bat is generally undetectable.

Some ball players have also been known to induce delamination between the composite layers in a composite bat barrel. This delamination lowers the barrel's compression and increases the barrel's flex, which can enhance the bat's performance. The most common method for causing barrel delamination is "rolling," wherein the bat barrel is placed between two cylinders oriented transversely to the barrel's long axis. The cylinders are then compressed into the bat while being rolled along the barrel to cause extreme deflections in the barrel structure. This process causes micro-cracking in the bat laminate, which eventually leads to delamination between the composite barrel layers. While this process generally reduces the bat's useful life, too many players opt for temporary enhanced performance over durability. As with shaving, alterations in the bat barrel resulting from rolling are typically undetectable by an observer.

In response to these bat-tampering methods, regulatory associations have begun to impose limitations on bat designs. The National Collegiate Athletic Association (NCAA), for example, has implemented a test that requires all bats to comply with performance limits even after they are rolled an unlimited number of times. Essentially, the bat must either remain below the maximum allowable performance limit or must break during the rolling. Accordingly, it is becoming increasingly challenging to design a high-performance ball bat that meets the requirements of regulatory associations. Nearly all other baseball and softball sports governing bodies, for example, the Amateur Softball Association (ASA), the United States Specialty Sports Association (USSSA), Little League, and so forth have adopted similar regulations.

SUMMARY

A ball bat includes one or more low-durability regions fortified by one or more reinforcing elements. If the reinforcing element is altered or removed, the durability of the ball bat is significantly reduced. For example, if the ball bat is subjected to internal shaving or external rolling in an attempt to increase the bat's performance, the reinforcing element would de removed or damaged such that the durability of the bat is reduced to the point that the ball bat's performance remains below a specified limit. Other features and advantages will appear hereinafter. The features described above can be used separately or together, or in various combinations of one or more of them.

BRIEF DESCRIPTION OF THE DRAWINGS

In the drawings, wherein the same reference number indicates the same element throughout the views.

DETAILED DESCRIPTION OF THE DRAWINGS

Various embodiments of the invention will now be described. The following description provides specific details for a thorough understanding and enabling description of these embodiments. One skilled in the art will understand, however, that the invention may be practiced without many of these details. Additionally, some well-known structures or functions may not be shown or described in detail so as to avoid unnecessarily obscuring the relevant description of the various embodiments.

The terminology used in the description presented below is intended to be interpreted in its broadest reasonable manner, even though it is being used in conjunction with a detailed description of certain specific embodiments of the invention. Certain terms may even be emphasized below; however, any terminology intended to be interpreted in any restricted manner will be overtly and specifically defined as such in this detailed description section.

Where the context permits, singular or plural terms may also include the plural or singular term, respectively. Moreover, unless the word "or" is expressly limited to mean only a single item exclusive from the other items in a list of two or more items, then the use of "or" in such a list is to be interpreted as including (a) any single item in the list, (b) all of the items in the list, or (c) any combination of items in the list.

Figure 1:
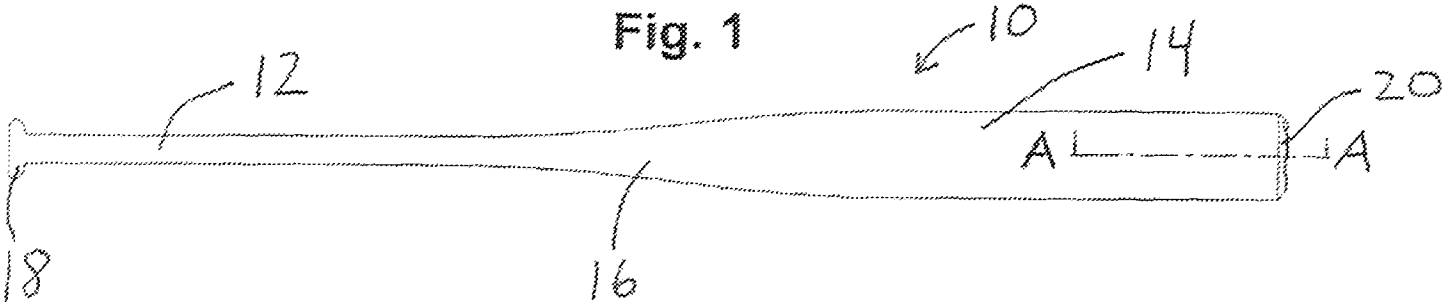
FIG. 1 is a perspective view of a ball bat, according to one embodiment.

Turning now in detail to the drawings, as shown in FIG. 1, a baseball or softball bat 10, hereinafter collectively referred to as a "ball bat" or "bat," will be shown and described. The ball bat 10 includes a handle 12, a barrel 14, and a tapered section 16 joining the handle 12 to the barrel 14. The free end of the handle 12 includes a knob 18 or similar structure. The barrel 14 is preferably closed off by a suitable cap 20 or plug. The interior of the bat 10 is preferably hollow, allowing the bat 10 to be relatively lightweight so that ball players may generate substantial bat speed when swinging the bat 10.

The ball bat 10 may be a one-piece construction or may include two or more separate attached pieces (for example, a separate handle and barrel), as described, for example, in U.S. Pat. No. 5,593,158, which is incorporated herein by reference. The barrel 14 may be made of a composite material, such as carbon or glass, or of a metal material, such as aluminum. The bat handle 12 may be constructed from the same material as, or different materials than, the barrel 14. In a two-piece ball bat, for example, the handle 12 may be constructed from a composite material (the same or a different material than that used to construct the barrel), a metal material, or any other suitable material.

The bat barrel 14 may include a single-wall or multi-wall construction. A multi-wall barrel may include, for example, barrel walls that are separated from one another by one or more interface shear control zones ("ISCZs"), as described in detail in U.S. Pat. No. 7,115,054, which is incorporated herein by reference.

The ball bat 10 may have any suitable dimensions. The ball bat 10 may have an overall length of 20 to 40 inches, or 26 to 34 inches. The overall barrel diameter may be 2.0 to 3.0 inches, or 2.25 to 2.75 inches. Typical ball bats have diameters of 2.25, 2.625, or 2.75 inches. Bats having various combinations of these overall lengths and barrel diameters, or any other suitable dimensions, are contemplated herein. The specific preferred combination of bat dimensions is generally dictated by the user of the bat 10, and may vary greatly between users.

The bat barrel 14 includes at least one weakened region, or a region having reduced durability relative to other regions of the barrel 14. This weakened region may be located at or substantially at the center of percussion or sweet spot of the barrel 14, or at one or more other suitable locations. The weakened region is fortified by a reinforcing element that provides durability necessary for the ball bat to withstand impacts associated with competitive play, such as striking a pitched baseball or softball.

Figure 2:
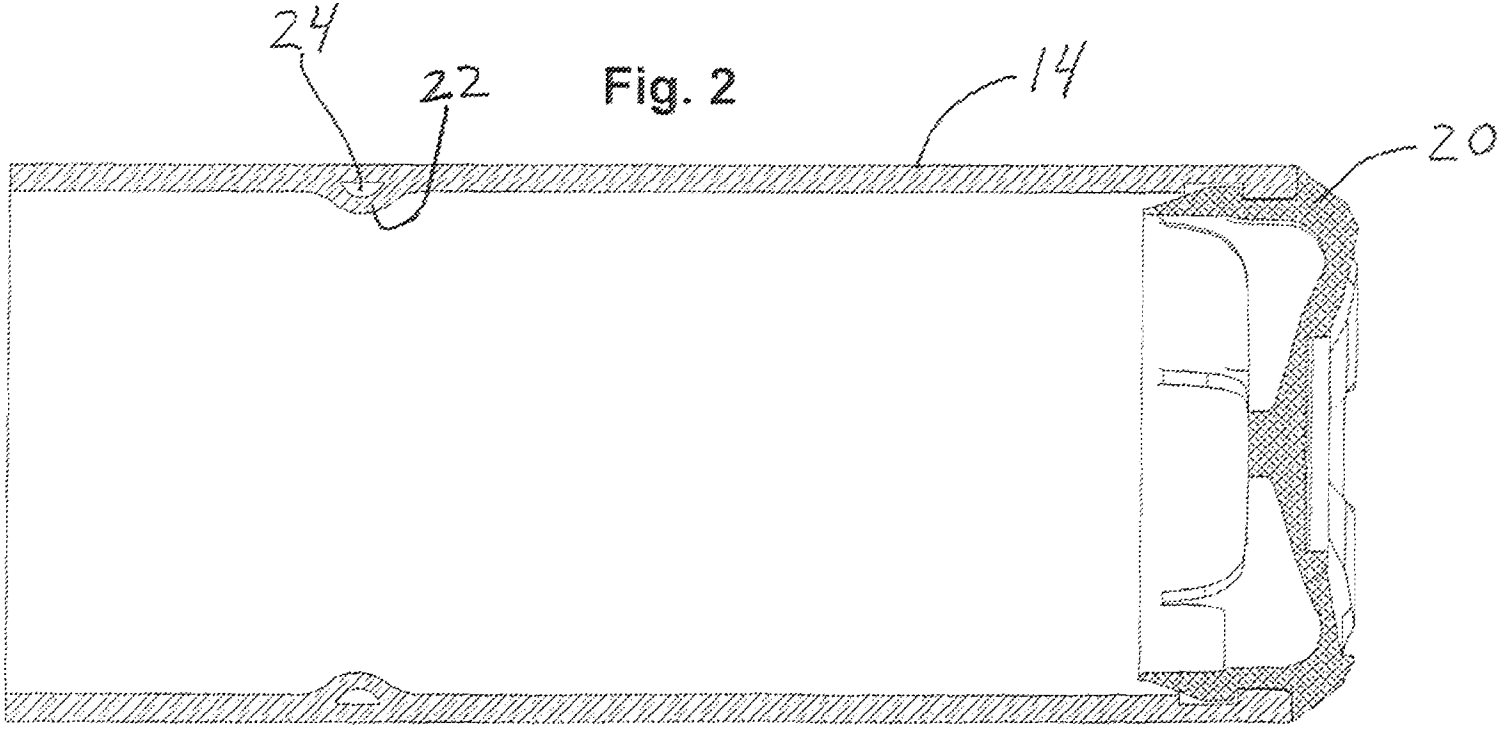
FIG. 2 is a sectional view of the bat barrel taken along line A-A of FIG. 1, according to one embodiment.

As shown in FIG. 2, in one embodiment the reinforcing element includes one or more ribs 22 or similar features that protrude radially inwardly from the radially inner surface of the barrel 14. In the embodiment shown in FIG. 2, a single inwardly protruding rib 22 is located over a single weakened region 24 located substantially at the sweet spot of the bat barrel 14. The one or more ribs 22 may alternatively be located anywhere in the hitting zone of the barrel 14, which typically extends approximately from two inches to eight inches from the end of the ball bat 10. In another embodiment, one or more ribs 22 may be located outside of the hitting zone, preferably toward the cap-end of the ball bat where shaving typically begins.

The rib 22 preferably has a length of approximately 0.625 to 1.000 inches in the longitudinal direction of the bat barrel 14. The rib 22 alternatively could be longer or shorter. In some embodiments, for example, the rib 22 could have a length of 6.000 inches or more. The rib 22 preferably is positioned along the full circumference of the radially inner surface of the barrel 14 but smaller, discontinuous ribbed sections could alternatively be used. Because the rib 22 protrudes inwardly, it has a smaller inner diameter than neighboring regions of the bat barrel 14. In one embodiment, the rib's inner diameter is approximately 0.020 inches less than the inner diameter of neighboring barrel regions so that it resides in the path of any machinery used to shave the inner surface of the bat barrel 14. The rib 22 may alternatively protrude inwardly from the inner surface of the barrel 14 to a greater or lesser degree.

In a composite ball bat, the rib 22 may be formed from one or more layers of the composite material used to construct the bat barrel 14. Alternatively, a higher stiffness material, such as a stiffer composite or metal material, may be used to form the rib 22, particularly if the barrel material has a relatively low stiffness. Including a higher-stiffness rib 22 on the radially inner surface of the barrel 14 renders the barrel structure more dependent on the presence of the stiffer material. Accordingly, if the rib 22 is shaved or machined away, the barrel 14 immediately undergoes a significant drop in durability.

Additionally, the fiber types and fiber angles of the one or more composite materials used to form the rib 22 may be selected to cause a significant reduction in barrel durability when the barrel 14 is subjected to rolling or other severe deflection. Low-elongation fibers, such as high-modulus carbon fibers having less than 2% elongation, for example, may be used to construct the rib 22. In one embodiment, the fibers are oriented at an angle greater than approximately 30 degrees relative to the longitudinal axis of the bat 10, which increases the likelihood the barrel laminate will fail when the barrel is subjected to radial deflections greater than approximately 0.1 inches, such as those caused by rolling.

The weakened region 24 may be a hollow chamber extending through the barrel wall or it may be made up of—or filled with—one or more weak materials. Some relatively weak materials that could be used in the weakened region 24 include foam (for example, polyurethane, polystyrene, or thermoplastic foam), rope, balsa, textile yarn, polypropylene, or other suitable materials. Elastomers, such as polyurethane or silicone, could also be used to form the weakened region 24. Additionally or alternatively, weaker laminate fibers or a weaker resin matrix than those used to construct the remainder of the barrel 14—or a material that is not bonded to the surrounding laminate layers—could be used to form the weakened region 24. These relatively weak materials and arrangements provide sufficient durability when the reinforcing rib 22 is present but will break down if the rib 22 or other inwardly protruding feature is machined away.

Figure 3:
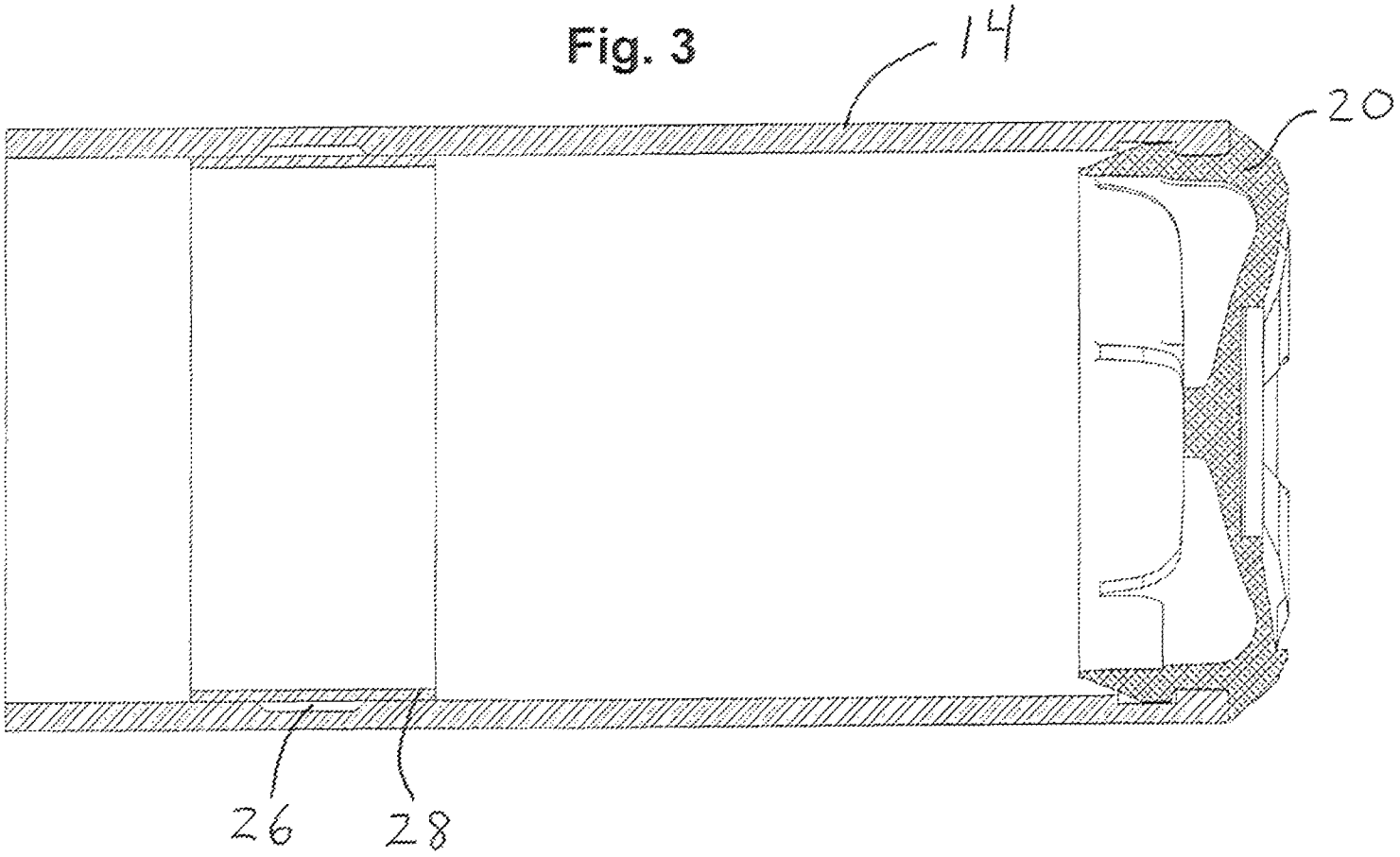
FIG. 3 is a sectional view of the bat barrel taken along line A-A of FIG. 1, according to another embodiment.

As shown in FIG. 3, in another embodiment, a weakened region 26 of a composite or metal bat barrel 14 is formed by fabricating the barrel 14 with a region having a lesser thickness than neighboring barrel regions. The weakened region 26 is covered by a structural patch 28 or other reinforcing element that is bonded or otherwise attached to the radially inner surface of the barrel 14 adjacent to the weakened region 26. The patch 28 protrudes inwardly from the radially inner surface of the barrel wall, thus decreasing the inner diameter of the barrel 14 in that region and positioning the patch 28 in the path of machinery used to shave the inner surface of the barrel 14.

The material used to construct the patch 28—or to bond the patch to the inner surface of the barrel 14—may be selected to fail when the barrel 14 is subjected to excessive radial deflections greater than approximately 0.1 inches, such as those resulting from rolling. High modulus, low-elongation carbon fibers, such as those described above, could be used to construct the patch 28 and achieve this result. Additionally or alternatively, low-elongation adhesives (for example, epoxy, acrylic, or cyanoacrylate) could be used to bond the patch 28 to the bat barrel 14. Such an adhesive breaks down under extreme loading conditions, such as the radial deflections resulting from rolling or similar practices.

The reduction in barrel thickness in the weakened region 26 necessary to achieve the desired drop in barrel durability depends on the strength of the materials used to construct the bat and the level of play at which the bat will be used. For example, a typical adult baseball bat made of a high-strength aluminum alloy generally has a barrel-wall thickness of approximately 0.100 inches to 0.110 inches. Incorporating in such a bat a weakened region 26 having a length of approximately 0.5 inches in the longitudinal direction of the ball bat, and a thickness of approximately 0.075 inches, would result in barrel-denting under normal use in the absence of a reinforcing element, such as a patch 28. A high-strength aluminum alloy ring having a thickness of approximately 0.040 inches, for example, would be a suitable patch 28 for supporting such a thinned, weakened region 26.

In general, a reduction of approximately 25% or more of the wall thickness in a given ball bat should be sufficient to cause barrel failure after the inner surface of the barrel 14 is machined away or the patch 28 is broken or de-bonded. Lower reductions in barrel-wall thickness (for example, an approximately 10% reduction) could provide similar results but might allow the bat to perform at a relatively high level for several impacts after the barrel is shaved, rolled, or otherwise modified.

In one embodiment, the radially outer surface of the patch 28 is bonded to the radially inner surface of the barrel 14 via a tough polyurethane or epoxy adhesive. Film adhesives typically work well and generally are easier to control and position than non-film adhesives. The bond strength between the patch 28 and the barrel 14 can be regulated by limiting the bonding area or by leaving the mating surfaces of the patch 28 and the barrel 14 unprepared (i.e., by using smooth surfaces that do not bond as strongly as prepared surfaces).

In another embodiment, the barrel wall—or one or more of the radially inner layers of the barrel wall—may be made of one or more materials that are difficult to shave or otherwise machine away. Materials of this nature may alternatively be bonded or otherwise attached to the radially inner surface of a barrel wall made of a more readily machinable material. Some examples of suitable shaving-resistant materials include but are not limited to the following: soft, sticky materials (for example, composite materials with relatively high melting points); stringy, difficult-to-cut fibers, such as aramid fibers; and particles or wires made of materials that are at least as hard as typical machining cutters, such as tungsten carbide, which would damage or wear on the cutters.

Any of the above-described embodiments may be used alone or in combination with one another. For example, a bat barrel may include a weakened region reinforced by a rib or a similar reinforcing element, and may include another weakened or thinned region reinforced with a structural patch. These regions may be positioned near the barrel's sweet spot or may be located in other regions inside or outside the hitting zone. The ball bat may also include features not described herein. While several embodiments have been shown and described, various changes and substitutions may of course be made, without departing from the spirit and scope of the invention. The invention, therefore, should not be limited, except by the following claims and their equivalents.

What is claimed is:

1. A ball bat, comprising:

a handle;

a substantially inelastic barrel attached to or integral with the handle and extending from the handle to a distal end, the barrel including a continuous outer surface and a radially innermost surface, the barrel further including a low-durability region comprising a reduced-thickness portion of the substantially inelastic barrel; and at least one reinforcing element protruding radially inwardly from the radially innermost surface and overlying the low-durability region, the reinforcing element protruding radially inwardly beyond longitudinally neighboring barrel regions and not extending to the distal end of the barrel, wherein removal of the reinforcing element significantly reduces the durability of the barrel.

2. The ball bat of claim 1 wherein the reinforcing element is a rib positioned along the circumference of the radially inner surface.

3. The ball bat of claim 1 wherein the low-durability region comprises a material having a first stiffness, and wherein the reinforcing element comprises a material having a second stiffness that is greater than the first stiffness.

4. The ball bat of claim 1 wherein the barrel comprises a wall that comprises a material having a first stiffness, and wherein the reinforcing element comprises a material having a second stiffness that is greater than the first stiffness.

5. The ball bat of claim 1 wherein the barrel comprises at least one wall, and wherein the low-durability region comprises an empty, hollow chamber in the barrel wall.

6. The ball bat of claim 1 wherein the barrel includes a sweet spot, and wherein the low-durability region and the reinforcing element are located substantially at the sweet spot.

7. The ball bat of claim 1 wherein the barrel includes at least two low-durability regions, and wherein each of the low-durability regions is overlain by a reinforcing element that protrudes inwardly from the radially inner surface of the barrel.

8. The ball bat of claim 1 wherein the reinforcing element protrudes radially inwardly from the inner surface of the barrel by approximately 0.020 inches.

9. The ball bat of claim 1 wherein the reinforcing element comprises a high-modulus composite material including fibers having less than 2% elongation.

10. The ball bat of claim 9 wherein the fibers are oriented at an angle of at least approximately 30 degrees relative to a longitudinal axis of the bat.

11. The ball bat of claim 1 wherein the reduced-thickness portion of the barrel has a thickness at least 10% less than that of longitudinally neighboring barrel regions.

12. The ball bat of claim 1 wherein the reduced-thickness portion of the barrel has a thickness at least 25% less than that of longitudinally neighboring barrel regions.

13. A ball bat, comprising:

a handle;

a substantially inelastic barrel attached to or integral with the handle and extending from the handle to a distal end, the barrel including a low-durability region having a thickness at least 10% less than that of longitudinally neighboring barrel regions; and at least one reinforcing element protruding radially inwardly from a radially innermost surface of the barrel, the reinforcing element protruding radially inwardly beyond longitudinally neighboring barrel regions and overlying the low-durability region, wherein the reinforcing element does not extend to the distal end of the barrel, and wherein removal of the reinforcing element significantly reduces the durability of the barrel.

14. The ball bat of claim 13 wherein the low-durability region has a thickness at least 25% less than that of the longitudinally neighboring barrel regions.

15. The ball bat of claim 13 wherein the barrel comprises at least one wall, and wherein the low-durability region includes an empty, hollow chamber in the barrel wall.

16. A ball bat, comprising:

a handle;

a substantially inelastic barrel attached to or integral with the handle and extending from the handle to a distal end, the barrel including a low-durability region; and at least one reinforcing element protruding radially inwardly from a radially innermost surface of the barrel and forming an inner border of the low-durability region such that the low durability region comprises a fully enclosed chamber in the barrel wall, wherein the reinforcing element does not extend to the distal end of the barrel, and wherein removal of the reinforcing element significantly reduces the durability of the barrel.

17. The ball bat of claim 16 wherein the chamber is filled with a weak material.

18. The ball bat of claim 16 wherein the low-durability region of the barrel has a thickness at least 10% less than that of longitudinally neighboring barrel regions.

19. The ball bat of claim 16 wherein the low-durability region has a thickness at least 25% less than that of the longitudinally neighboring barrel regions.

* * * * *